US007427222B2

(12) United States Patent
Auck et al.

(10) Patent No.: US 7,427,222 B2
(45) Date of Patent: Sep. 23, 2008

(54) REVERSION CONTROL DEVICE FOR WATERCRAFT EXHAUST SYSTEM

(76) Inventors: Edward Auck, 502 Quail Meadow, Irvine, CA (US) 92603; Robert M. Kelly, 69 Woodland St., Natick, MA (US) 01760

( * ) Notice: Subject to any disclaimer, the term of this patent is extended or adjusted under 35 U.S.C. 154(b) by 0 days.

(21) Appl. No.: 11/401,627

(22) Filed: Apr. 10, 2006

(65) Prior Publication Data

US 2007/0287341 A1 Dec. 13, 2007

(51) Int. Cl.
*F01N 7/00* (2006.01)

(52) U.S. Cl. ..... 440/89 E

(58) Field of Classification Search ..... 440/89 R, 440/89 E, 89 J; 60/324
See application file for complete search history.

(56) References Cited

U.S. PATENT DOCUMENTS 3,943,876 A * 3/1976 Kiekhaefer ..... 440/43
4,787,869 A 11/1988 Shiozawa
5,355,673 A * 10/1994 Sterling et al. ..... 60/324
5,591,058 A 1/1997 Schriever et al.
5,881,555 A 3/1999 Jaeger
5,934,959 A 8/1999 Inman, Sr. et al.
6,022,254 A * 2/2000 Neisen ..... 440/89 R
6,024,617 A 2/2000 Smullin et al.
6,206,741 B1 3/2001 Matsuda
6,213,827 B1 4/2001 Hattori et al.
6,564,901 B2 5/2003 Woods
6,739,922 B2 5/2004 Matsuda
6,769,942 B2 8/2004 Bourret et al.
6,800,005 B2 10/2004 Yokoya
6,896,568 B2 5/2005 Matsuda
2003/0134548 A1 7/2003 Yoshimoto
2003/0226539 A1 * 12/2003 Kim ..... 123/306
2004/0026166 A1 2/2004 Woods
2004/0048527 A1 3/2004 Noboru
2004/0058597 A1 3/2004 Yoshimoto
2004/0082236 A1 4/2004 Yoshimoto
2006/0057909 A1 3/2006 Noboru

FOREIGN PATENT DOCUMENTS

WO WO99/42361 8/1999

* cited by examiner

*Primary Examiner*—Sherman Basinger
(74) *Attorney, Agent, or Firm*—McDermott Will & Emery LLP

(57) ABSTRACT

The present invention is a reversion control device including a housing for a stationary vane and a flapper. In one example, the housing includes an expansion chamber to house the stationary vane and the flapper.

38 Claims, 7 Drawing Sheets

REVERSION CONTROL DEVICE FOR WATERCRAFT EXHAUST SYSTEM

FIELD

The field of the present invention relates generally to watercraft exhaust systems. More particularly, the present invention relates to a device attached to the exhaust system for controlling water reversion back to the engine.

BACKGROUND

In a typical motorized watercraft, the exhaust system includes an exhaust manifold elbow. The exhaust manifold elbow includes an exhaust gas passage and a water passage with the two passages juxtaposed. Exhaust gas from the engine exits the exhaust system through the exhaust gas passage. Water from the lake or ocean, injected into the exhaust system for cooling the running engine, passes near the exhaust gas passage, where it further cools the exhaust gas. The exhaust gas and cooling water exit the elbow mixing area of the exhaust manifold elbow and are mixed with each other. Ideally, both are then expelled.

In motorized watercraft, portions of the exhaust system can be immersed in the water (e.g., lake or ocean) while the engine is running. This arrangement may cause water to move back towards the engine through the gas passage. This is known as water reversion. Water reversion is undesirable for many reasons. Water in the engine may damage it. Water reversion may also decrease engine performance and increase fuel consumption since water moving upstream through the gas passage impedes the flow of exhaust exiting from the engine. In addition, reversion of cooling water may also occur to cause the above-mentioned problems, even in exhaust systems where the exhaust ejection point is not immersed in water so long as the system uses water for cooling the engine and/or exhaust gas.

Watercraft exhaust manufacturers have attempted several solutions to the problem of water reversion, such as placing a stationary, semi-perforated cap-like structure or a stationary plate in the exhaust manifold elbow area. While these attempted solutions may prevent some amount of water backflow, they also have the tendency to impede the flow of exhaust gas out of the exhaust system. Impeding exhaust gas flow decreases performance and increases fuel consumption.

Accordingly, it would be desirable to provide a device for controlling water reversion without decreasing engine performance or increasing fuel consumption.

SUMMARY

According to one aspect, the present invention provides a reversion control device including a housing with a proximal end and a distal end; a stationary vane housed near the proximal end of the housing; and a flapper housed near the distal end of the housing.

According to another aspect, the present invention provides a reversion control device including a housing with a proximal end, a distal end and an expansion chamber; a stationary vane housed within the expansion chamber near the proximal end; and a flapper housed within the expansion chamber near the distal end.

According to another aspect, the present invention provides an exhaust system for controlling water reversion comprising a reversion control device which includes a housing with a proximal end, a distal end and an expansion chamber, a stationary vane housed within the expansion chamber near the proximal end, and a flapper housed within the expansion chamber near the distal end; at least one exhaust mixture hose support attached to the reversion control device on the housing; an exhaust mixture hose surrounding the reversion control device and the exhaust mixture hose support; and at least one clamp on the exhaust mixture hose.

Other embodiments will be readily apparent to those skilled in the art from the following detailed description, wherein various embodiments are shown and described by way of illustration. The drawings arid detailed description are to be regarded as illustrative in nature and not as restrictive.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments. The detailed description includes specific details for the purpose of providing a thorough understanding of the present invention. It will be apparent to those skilled in the art, however, that the present invention may be practiced without these specific details.

Figure 1:
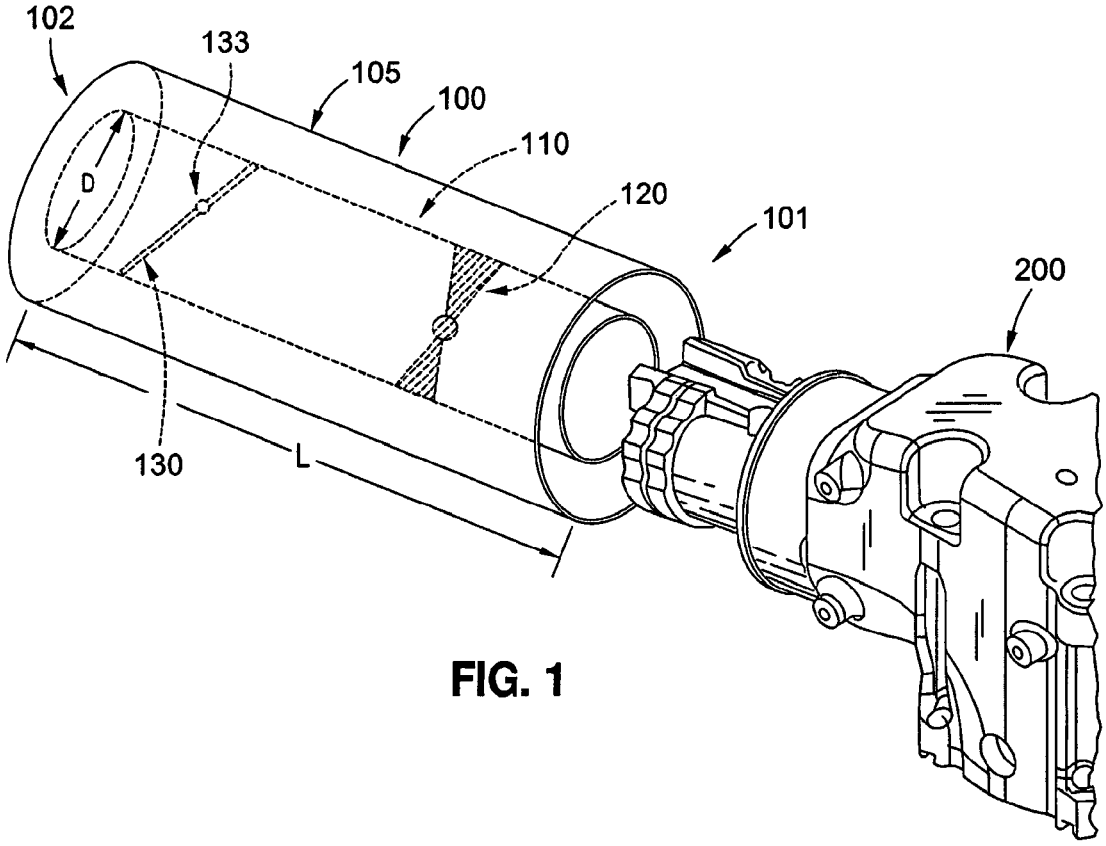
FIG. 1 shows the reversion control device next to an exhaust manifold elbow.

The present invention discloses a reversion control device 100. FIG. 1 shows the reversion control device 100 next to an exhaust manifold elbow 200. The reversion control device includes a housing 110 for a stationary vane 120 near the proximal end 101 and a flapper 130 near the distal end 102. The proximal end 101 is the portion of the reversion control device 100 that connects with the exhaust manifold elbow 200. The distal end 102 is the exit portion of the reversion control device 100 distal from the exhaust manifold elbow 200. Within the reversion control device 100, the stationary vane 120 organizes the exhaust gas flow, which increases fuel economy, while the flapper 130 at its closed position minimizes water reversion, and hence, minimizes degradation in engine performance or engine damage. During the emission of exhaust gas, the flapper 130 is at its open position. In the event of back pulsing by the engine, which can cause a suction, the flapper 130 flips to its closed position to minimize water reversion. The reversion control device 100 adds additional length to the typical exhaust outlet of the exhaust manifold elbow 200. The additional extension in length provided by the reversion control device 100 moves the mixture point of the exhaust gas and cooling water further away from the engine. FIG. 1 also shows an exhaust mixture hose 105 which surrounds the reversion control device 100 and connects to the exhaust manifold elbow 200 at the proximal end 101.

Figure 2A:
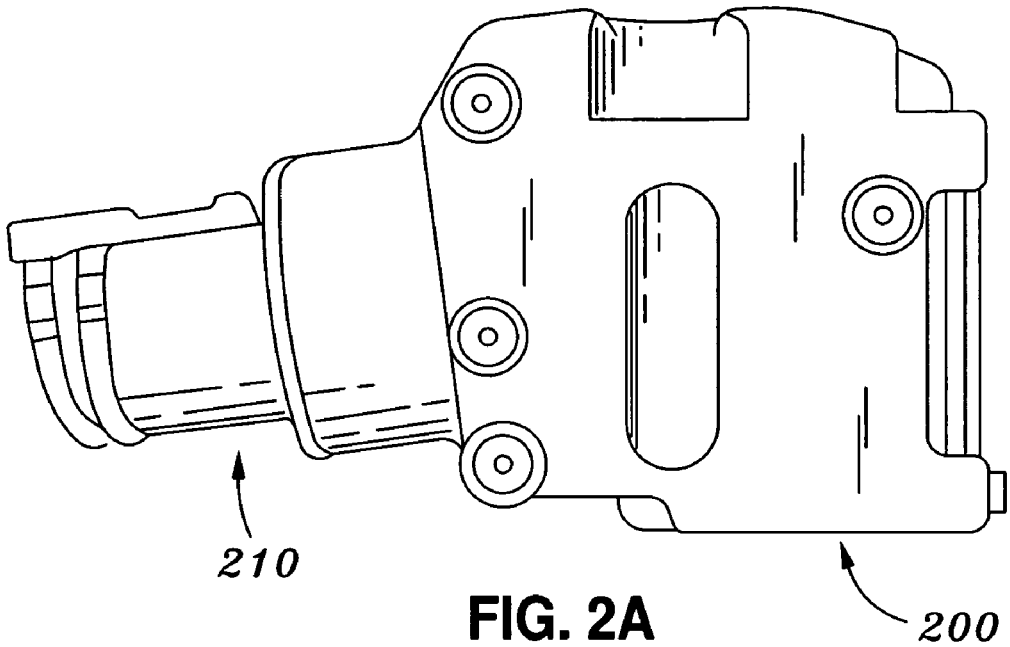
FIG. 2*a* is a side view of an exhaust manifold elbow.
Figure 2B:
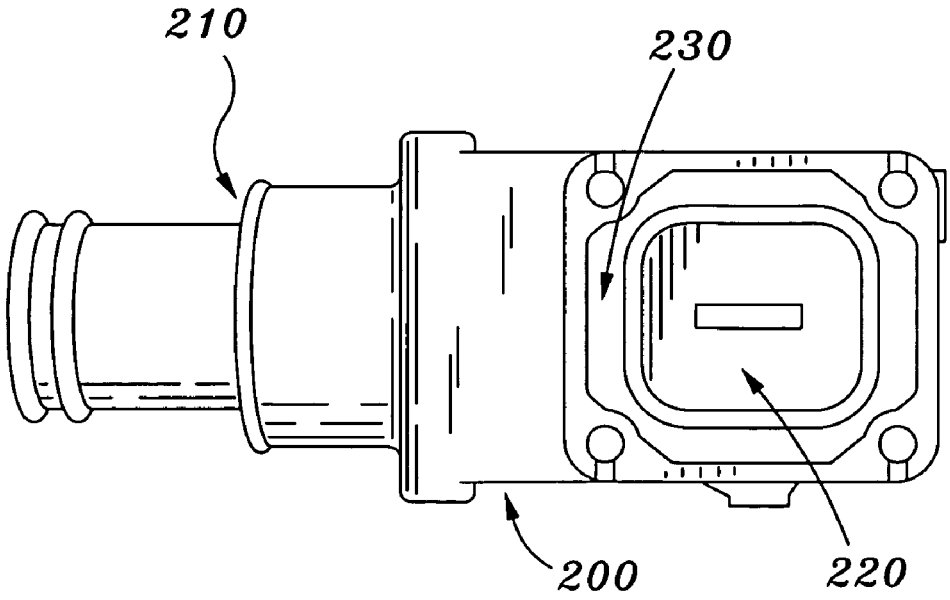
FIG. 2*b* is the bottom view of the exhaust manifold elbow shown in FIG. 2*a*.

FIG. 2*a* is a side view of an exhaust manifold elbow 200. The exhaust manifold elbow 200 includes an elbow mixing area 210 which connects to the reversion control device 100. FIG. 2*b* shows the bottom view of the exhaust manifold elbow 200. The exhaust manifold elbow 200 includes cooling water passage 230 and an exhaust gas passage 220.

Figure 3A:
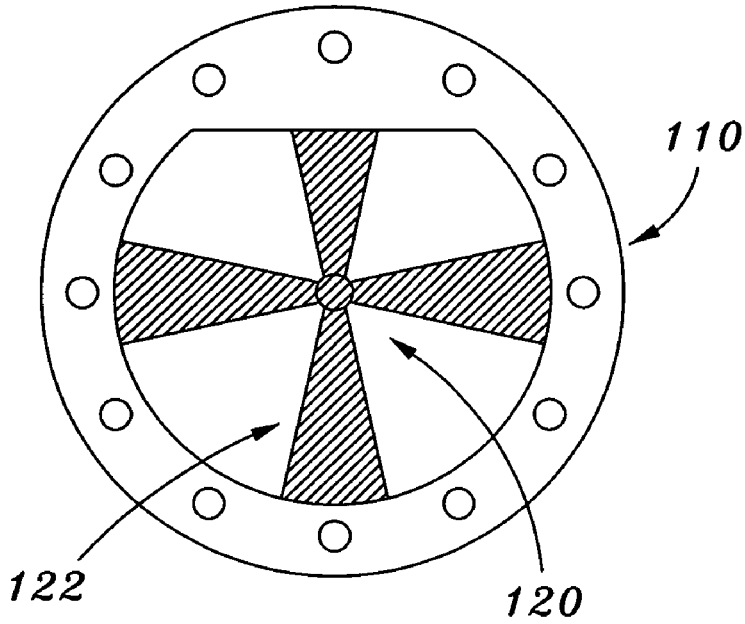
FIG. 3*a* is a front view of the stationary vane.
Figure 3B:
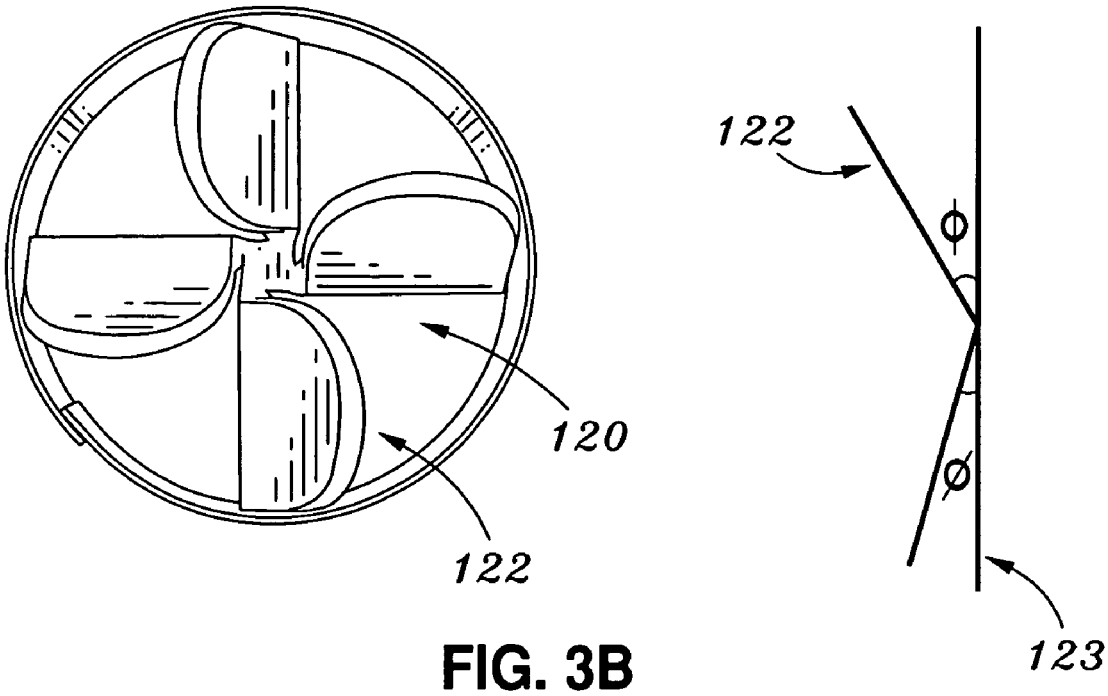
FIG. 3*b* shows the blades of the stationary vane.

FIG. 3*a* is a front view of the stationary vane 120. In the embodiment depicted, the stationary vane 120 includes four stationary blades 122. One skilled in the art would understand that the quantity of blades is not limited to four. The number of blades is a design choice and typically ranges from two to eight blades. FIG. 3*b* shows the blades 122 of the stationary vane 120. Although the blades 122 are shown as slightly "D" shaped, one skilled in the art would understand that the shape of the blades 122 may vary as a design choice. In one embodiment, the blades 122 each tilt at an angle $\phi$ (phi) relative to an imaginary vertical plane 123 within the housing 110 as shown in FIG. 3*b*. Typical tilt angles can range from 20 degree to 60 degree relative to the vertical plane 123. In one embodiment, the stationary blades 122 each tilt at an angle of about 35 degrees relative to an imaginary vertical plane 123 within the housing 110. One skilled in the art would understand that other degrees of tilt may be possible depending on the design choice.

Figure 4A:
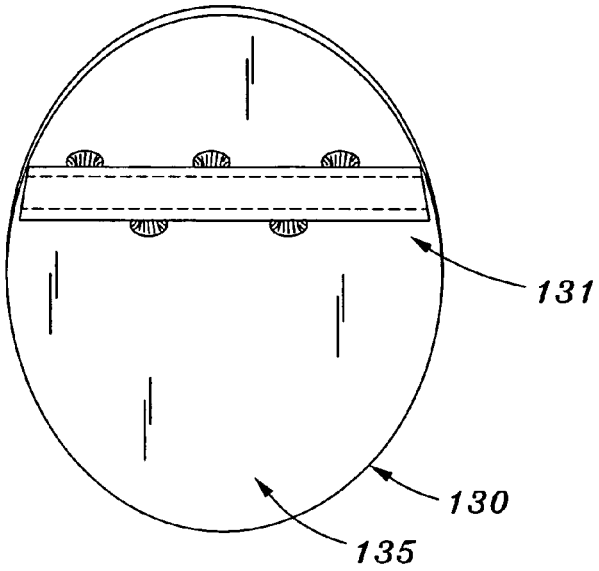
FIG. 4*a* shows the flapper as seen from the distal end.
Figure 4B:
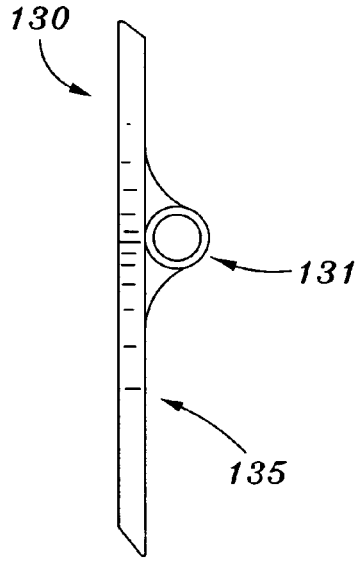
FIG. 4*b* shows the side view of the flapper in FIG. 4*a*.

FIG. 4*a* shows the flapper 130 as seen from the distal end. The flapper 130 includes a hinge tube 131. A rod 132 (shown in FIG. 4*d*) is inserted into the hinge tube 131 at the pivot point 133 on the housing (shown in FIG. 1) to allow the flapper 130 to open and to close. FIG. 4*b* is the side view of the flapper 130 and shows the location of the hinge tube 131 relative to the vertical height of the face 135 of the flapper 130. Typically, the hinge tube 131 is located on the top half of the face 135. However, one skilled in the art would understand that the location of the hinge tube 131 is a design choice and may depend on the angle at which the flapper is mounted to the housing 110. In one embodiment, the hinge tube 131 is an integral part of the face 135. In another embodiment, the hinge tube 131 is a separate piece secured to the face 135 through conventional techniques such as, but not limited, to welding. Yet other embodiments that will be readily apparent to one skilled in the art could have hinging mechanisms that do not require a tube and a separate rod.

Figure 4C:
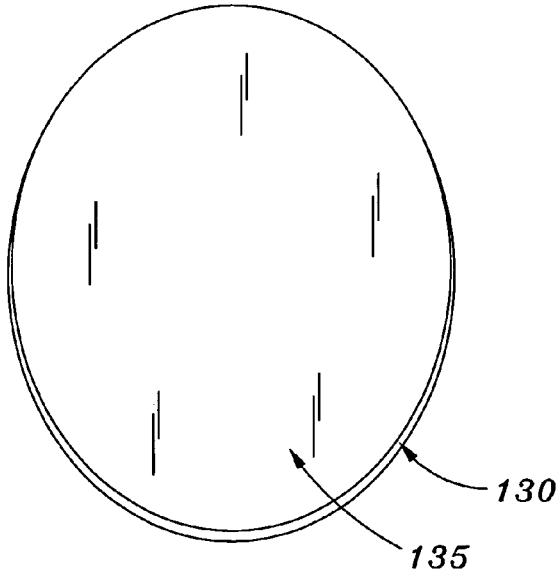
FIG. 4*c* shows the flapper as seen from the proximal end.
Figure 4D:
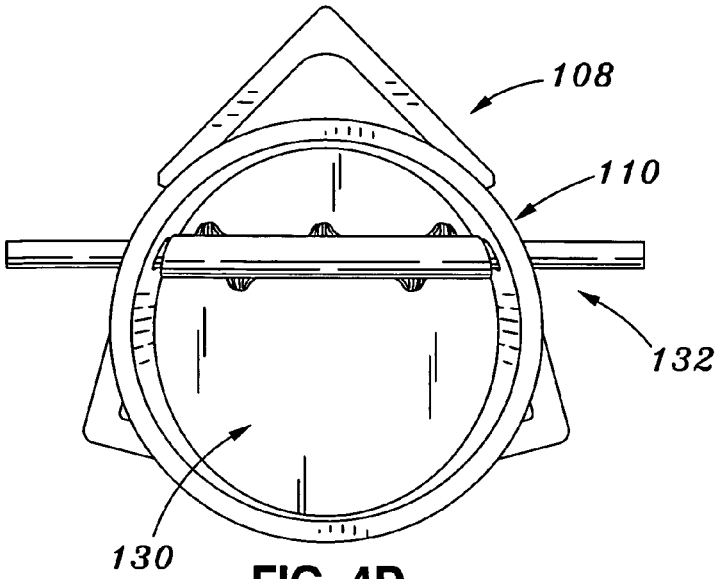
FIG. 4*d* shows the flapper in a closed position.
Figure 4E:
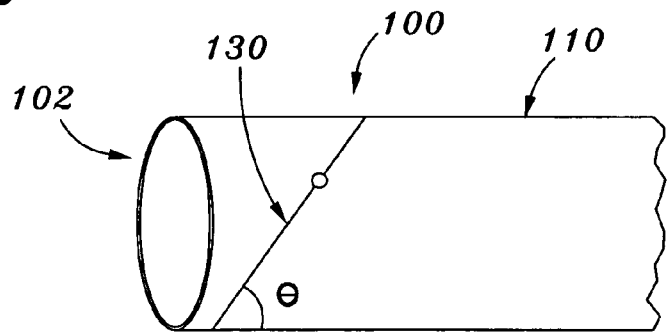
FIG. 4*e* shows the distal end of the reversion control device with the flapper mounted.
Figure 4F:
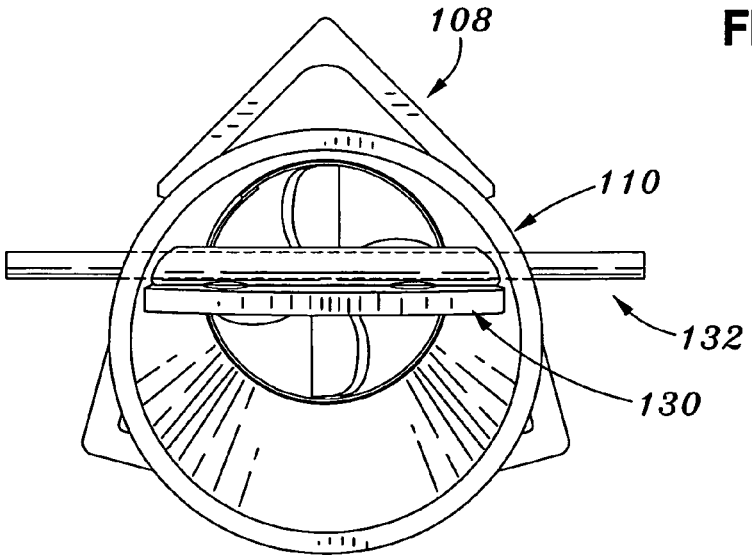
FIG. 4*f* shows the flapper in an open position.
Figure 5:
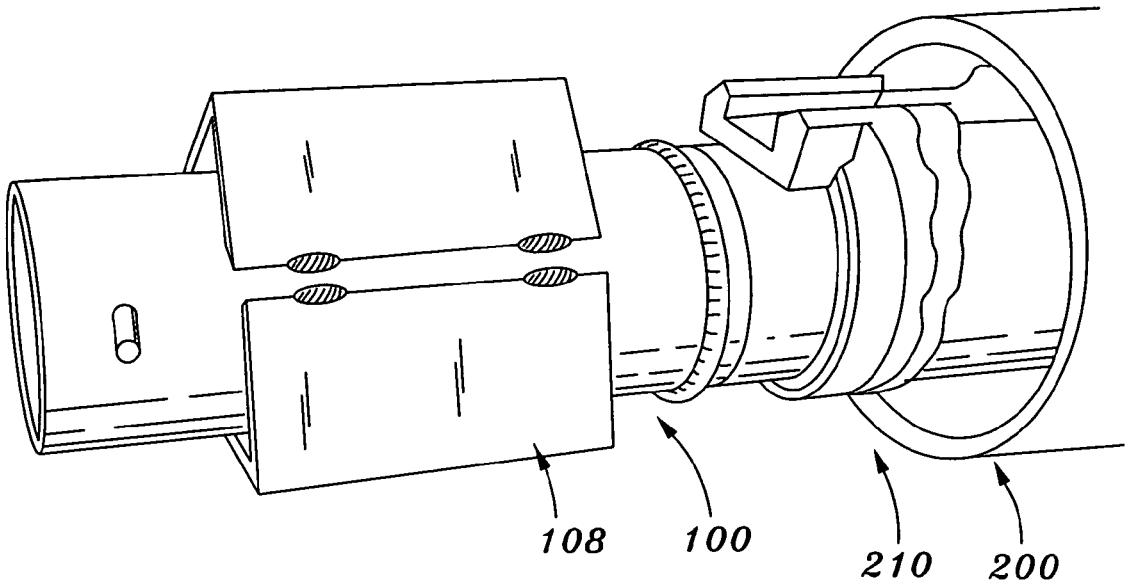
FIG. 5 shows the reversion control device mounted to the exhaust manifold elbow at the elbow mixing area.

FIG. 4*c* shows the flapper 130 as seen from the proximal end 102. FIG. 4*d* shows the flapper in a closed position within the housing 110, and FIG. 4*f* shows the flapper in an open position within the housing 110. In one embodiment, the flapper is mounted to the housing 110 at an angle $\Theta$ (theta) of about 30 degrees as shown in FIG. 4*e*. A typical range of the angle $\Theta$ (theta) is about 20 to 60 degrees. One skilled in the art would understand that angles outside this typical range are possible without substantially dimishing the effectiveness of the present invention. The reversion control device 100 is mounted to the exhaust manifold elbow 200 at the elbow mixing area 210 as shown in FIG. 5. As shown in FIG. 5, exhaust mixture hose supports 108 are mounted to housing 110 to keep the reversion control device 100 centered inside the exhaust mixture hose 105. In one embodiment, the exhaust mixture hose supports 108 are in a "V" shape. One skilled in the art would understand that other shapes may be used as a design choice. In one embodiment, a clamp is placed around the exhaust mixture hose 105 at the location of the exhaust mixture hose supports 108 to further secure the reversion control device 100.

In one embodiment, the attachment of the reversion control device 100 to the elbow mixing area 210 is by press fitting the proximal end 101 of the housing 110 into the elbow mixing area 210 and then further securing the connection with a clamp, usually over the exhaust mixture hose 105. One skilled in the art would understand that other types of fasteners may also be used.

Figure 6:
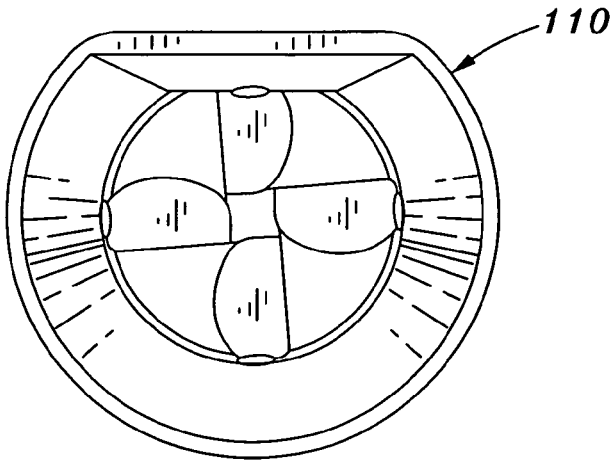
FIG. 6 shows the circumference of one embodiment of the proximal end of the housing.

In one embodiment, proximal end 101 has a circumference that is substantially circular for fitting into the elbow mixing area 210. In another embodiment, the proximal end 101 has a circumference that is partially circular, with a flat portion as shown in FIG. 6. The circumferential shape of the proximal end 101 can vary as needed to fit the shape of the elbow mixing area 210. The circumferential shape of the proximal end 101 can include, but is not limited to, square shape, rectangular shape, triangular shape and any polygon shape necessary to fit the circumferential shape of the elbow mixing area 210.

Figure 7A:
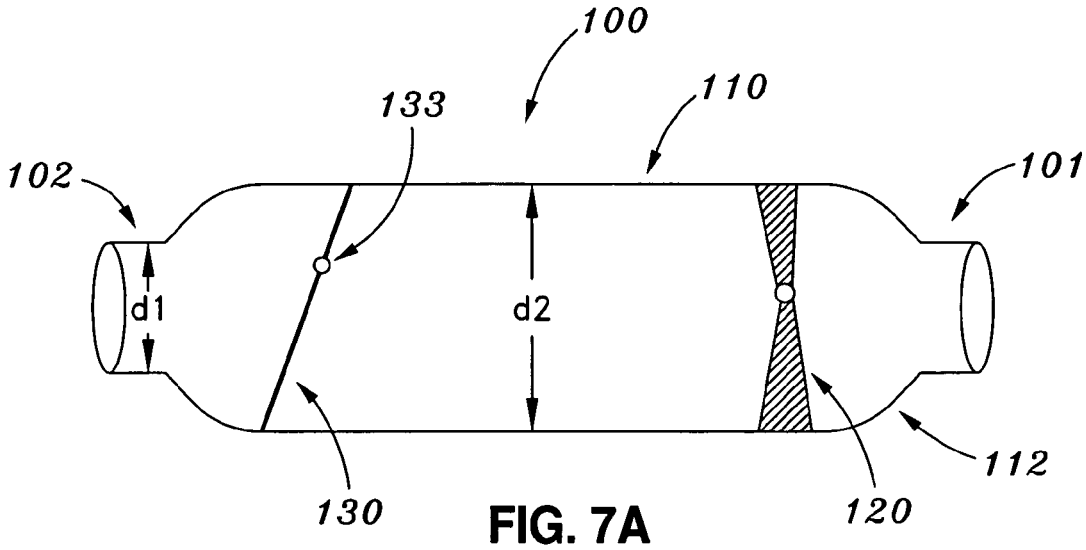
FIG. 7*a* shows a second embodiment of the housing.
Figure 7B:
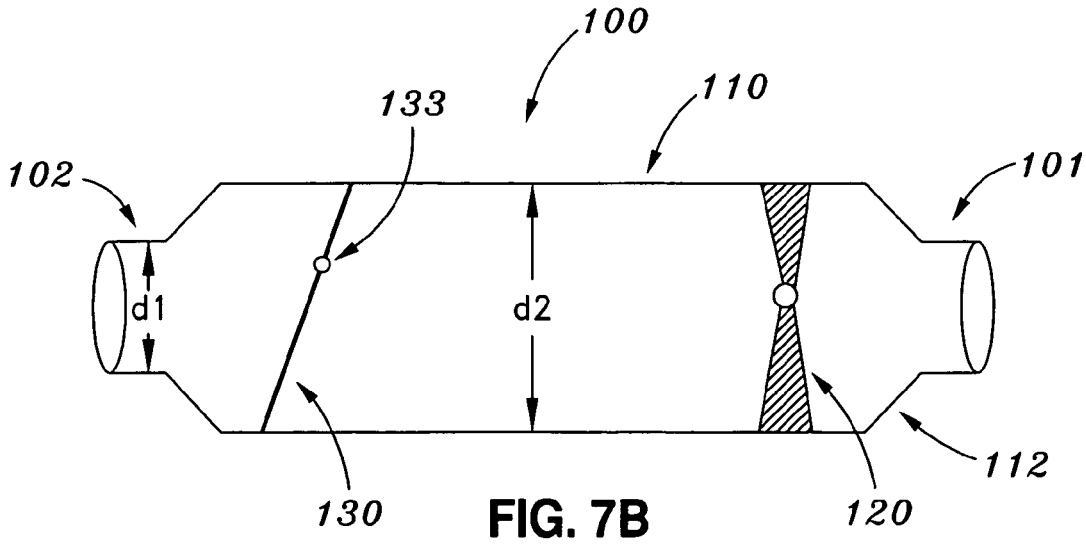
FIG. 7*b* shows a third embodiment of the housing.

In one embodiment, the housing 110 is a circular tube with one of a variety of shapes for its proximal end 101 to ensure appropriate fitting into the elbow mixing area 210. In two other embodiments, the housing 110 includes an expansion chamber 112 to house the stationary vane 120 and the flapper 130 as shown in FIGS. 7*a* and 7*b*. The transition from the proximal end 101 or the distal end 102 to the expansion chamber 112 can be a substantially straight linear transition as shown in FIG. 7*a* or a substantially curved transition as shown in FIG. 7*b*. In one embodiment, the ratio between the diameter $d_1$ of the distal end to the diameter $d_2$ of the expansion chamber is 1.5 times The ratio between the diameter $d_1$ of the distal end to the diameter $d_2$ of the expansion chamber can range from about 1.5 to 3 times One skilled in the art would understand that other ratios between and beyond the two diameters $d_1$ and $d_2$ are possible based on design choices.

In the embodiments shown in FIGS. 7*a* and 7*b*, the proximal end 101 can be a variety of shapes to insure appropriate fitting into the elbow mixing area 210. It is a feature of the embodiments referred to above that the proximal end 101 fits into the elbow mixing area 210. One skilled in the art, however, would understand that, in other embodiments, the elbow mixing area 210 may fit into the proximal end 101.

In one embodiment, the length L of the housing 110 (shown in FIG. 1) is about 8 inches while the diameter D of the housing 110 is about 2 inches. One skilled in the art would understand that the dimensions of the housing are not limited to this one embodiment and can vary according to the design choice with the limitation that the length L is always greater than the diameter D by at least two-fold.

In one embodiment, the flapper 130 is made of titanium. Other embodiments of the flapper 130 could be made of ceramic, stainless steel or carbon fiber. In one embodiment, the stationary vane 120 is made of stainless steel. Other embodiments of the stationary vane 120 could be made of titanium, carbon fiber or ceramic. In one embodiment, the housing 110 is made of stainless steel or a steel alloy. In another embodiment, the housing 110 is made of titanium. One skilled in the art would understand that the housing 110 can be made of other materials without affecting the effectiveness of the present invention. Material choices for the housing 110 are limited by the material's tolerance to endure the maximum exhaust gas temperature (typically at 1400 degrees Fahrenheit) and to endure the corrosive environment of the mixture of exhaust gas and cooling water.

In one embodiment, the flapper 130 and the housing 110 are made of the same material. In another embodiment, the stationary vane 120 and the housing 110 are made of the same material. In another embodiment, the flapper 130, the stationary vane 120 and the housing 110 are all made of the same material. In yet another embodiment, the flapper 130, the stationary vane 120 and the housing 110 are each made of a different material.

It is not essential to the present invention that the stationary vane 120 be proximal to the flapper 130 or that the flapper 130 be near the distal end of the device. It will be appreciated by those skilled in the art that the relative positions of the vane 120 and the flapper 130 can be altered without departing from the scope of the present invention.

It is not essential to the present invention that the reversion control device be separate or separable from the exhaust manifold elbow. It will be appreciated by those skilled in the art that, in yet another embodiment of the present invention, the distal portion of the exhaust manifold elbow 200 may comprise the housing 110 for the stationary vane 120 such that the stationary vane 120, or a portion of it, lies within the distal portion of the exhaust manifold elbow. In yet another embodiment of the present invention, the distal portion of the exhaust manifold elbow may comprise the housing 110 for the stationary vane 120 and the flapper 130 such that the stationary vane 120 lies within the distal portion of the exhaust manifold elbow as does the flapper 130, or a portion of it.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention.

What is claimed is:

1. A reversion control device comprising:

a housing with a proximal end and a distal end;

a stationary vane housed in the housing;

a flapper housed in the housing; and an exhaust mixture hose support attached to an outer wall of the housing for positioning the reversion control device inside an exhaust mixture hose.

2. The reversion control device of claim 1, wherein the stationary vane is housed near the proximal end of the housing.

3. The reversion control device of claim 2, wherein the housing has a length L of about 8 inches.

4. The reversion control device of claim 3, wherein the housing has a diameter of about 2 inches.

5. The reversion control device of claim 1, wherein the flapper is housed near the distal end of the housing.

6. The reversion control device of claim 1, wherein the distal portion of an exhaust manifold elbow comprises the housing.

7. The reversion control device of claim 1, wherein the reversion control device is connected to an exhaust manifold elbow at the proximal end.

8. The reversion control device of claim 7, wherein the exhaust manifold elbow includes an exhaust gas passage for exiting exhaust gas, a water passage for exiting water and an elbow mixing area for connecting to the proximal end.

9. The reversion control device of claim 8, wherein the proximal end fits into the elbow mixing area.

10. The reversion control device of claim 8, wherein the elbow mixing area fits into the proximal end.

11. The reversion control device of claim 1, wherein the stationary vane comprises a plurality of stationary blades.

12. The reversion control device of claim 11, wherein the plurality of stationary blades is four.

13. The reversion control device of claim 12, wherein each of the plurality of stationary blades comprises a slightly D shape.

14. The reversion control device of claim 11, wherein each of the plurality of stationary blades tilts at an angle of about 35 degrees relative to a vertical plane within the housing.

15. The reversion control device of claim 1, wherein the housing includes a pivot point; and the flapper includes a hinge tube wherein a rod is inserted into the hinge tube at the pivot point to pivot the flapper from an open position to a closed position or from a closed position to an open position.

16. The reversion control device of claim 15, wherein the hinge tube is an integral part of the flapper.

17. The reversion control device of claim 15, wherein the hinge tube is a separate piece from the flapper.

18. The reversion control device of claim 17, wherein the hinge tube is welded to the flapper.

19. The reversion control device of claim 15, wherein the flapper includes a face and wherein the hinge tube is located on the face such that, when the flapper is mounted within the housing, the face of the flapper is at an angle Θ (theta) between about 20 to about 60 degrees.

20. The reversion control device of claim 19, wherein the angle Θ (theta) is about 30 degrees.

21. The reversion control device of claim 1, wherein the proximal end includes a circumference that is substantially circular.

22. The reversion control device of claim 21, wherein the housing is a circular tube.

23. The reversion control device of claim 1, wherein the proximal end includes a circumference that is partially circular, with a flat portion.

24. The reversion control device of claim 23, wherein the housing is a circular tube.

25. The reversion control device of claim 1, wherein the housing is a circular tube.

26. The reversion control device of claim 1, wherein the housing has a diameter of about 2 inches.

27. The reversion control device of claim 1, wherein the housing includes an expansion chamber to house the stationary vane and the flapper.

28. The reversion control device of claim 27, wherein the ratio between the diameter d1 of the distal end to the diameter d2 of the expansion chamber is between about 1.5 to about 3 times.

29. The reversion control device of claim 28, wherein the ratio between the diameter d1 of the distal end to the diameter d2 of the expansion chamber is about 1.5 times.

30. The reversion control device of claim 1, wherein the transition from the expansion chamber to the proximal end is a substantially straight linear transition.

31. The reversion control device of claim 1, wherein the transition from the expansion chamber to the proximal end is a substantially curved transition.

32. The reversion control device of claim 1 wherein the housing is made of stainless steel.

33. The reversion control device of claim 32 wherein the flapper is made of titanium.

34. The reversion control device of claim 1 wherein the flapper is made of titanium.

35. The reversion control device of claim 1 wherein the stationary vane is made of stainless steel.

36. The reversion control device of claim 1 wherein the housing, the stationary vane and the flapper are made of the same material.

37. A reversion control device comprising:

a housing with a proximal end, a distal end and an expansion chamber, a stationary vane housed within the expansion chamber near one of the proximal end and the distal end; and a flapper housed within the expansion chamber near the other of the proximal end and the distal end; and an exhaust mixture hose support attached to an outer wall of the housing for positioning the reversion control device inside an exhaust mixture hose.

38. An exhaust system for controlling water reversion comprising:

a reversion control device comprising a housing with a proximal end, a distal end and an expansion chamber, a stationary vane housed within the expansion chamber near one of the proximal end and the distal end, and a flapper housed within the expansion chamber near the other of the proximal end and the distal end;

at least one exhaust mixture hose support attached to the reversion control device on an outer wall of the housing; and an exhaust mixture hose surrounding the reversion control device and the at least one exhaust mixture hose support, wherein the at least one mixture hose support positions the reversion control device inside the exhaust mixture hose.

* * * * *